US009761215B2

(12) United States Patent
Sutton

(10) Patent No.: US 9,761,215 B2
(45) Date of Patent: Sep. 12, 2017

(54) TECHNIQUES FOR MAGNETICALLY MOUNTING A TRANSDUCER TO A CYMBAL AND RELATED SYSTEMS AND METHODS

(71) Applicant: Avedis Zildjian Co., Norwell, MA (US)

(72) Inventor: Michael Rangel Sutton, Abington, MA (US)

(73) Assignee: Avedis Zildjian Co., Norwell, MA (US)

( * ) Notice: Subject to any disclaimer, the term of this patent is extended or adjusted under 35 U.S.C. 154(b) by 0 days.

(21) Appl. No.: 14/931,812

(22) Filed: Nov. 3, 2015

(65) Prior Publication Data

US 2017/0125004 A1 May 4, 2017

(51) Int. Cl.

| | |
|---|---|
| ***G10H 3/14*** | (2006.01) |
| ***G10K 11/00*** | (2006.01) |
| ***G10D 13/06*** | (2006.01) |

(52) U.S. Cl.

CPC ..... *G10K 11/004* (2013.01); *G10D 13/06* (2013.01)

(58) Field of Classification Search

CPC ..... G10H 3/146; G10H 1/0008; G10H 2220/395; G10H 2220/126; G10H 1/0025; G10H 1/0066; G10H 1/42; G10H 2210/066; G10H 2210/125; G10H 2220/106; G10H 2220/111; G10H 2240/075; G10H 1/18; G10H 1/34; G10H 2220/391; G10H 2230/281; G10H 2230/321

See application file for complete search history.

(56) References Cited

U.S. PATENT DOCUMENTS

| | | | | |
|---|---|---|---|---|
| 5,934,629 | A | 8/1999 | Peritz | |
| 7,323,632 | B2 | 1/2008 | Wachter | |
| 8,410,348 | B1 * | 4/2013 | Hsieh | G10H 1/32 84/725 |
| 8,729,378 | B2 * | 5/2014 | Ryan | G10D 13/06 381/118 |
| 2005/0087019 | A1 * | 4/2005 | Face | G01N 29/14 73/649 |

(Continued)

FOREIGN PATENT DOCUMENTS

| | | | |
|---|---|---|---|
| CN | 104795060 | A | 7/2015 |

OTHER PUBLICATIONS

Invitation to Pay Additional Fees for International Application No. PCT/US16/60239 dated Jan. 6, 2017.

(Continued)

*Primary Examiner* — Marlon Fletcher

(74) *Attorney, Agent, or Firm* — Wolf, Greenfield & Sacks, P.C.

(57) ABSTRACT

According to some aspects, a cymbal system is provided, comprising a cymbal, and a vibrational transducer magnetically coupled to the cymbal, the magnetic coupling provided by at least one magnetic component on an upper side of the cymbal and at least one magnetic component on a lower side of the cymbal. According to some aspects, a method for transducing vibrations of a cymbal is provided, comprising magnetically coupling a vibrational transducer to a cymbal, the magnetic coupling provided by at least one magnetic component on an upper side of the cymbal and at least one magnetic component on a lower side of the cymbal.

11 Claims, 4 Drawing Sheets

(56) References Cited

U.S. PATENT DOCUMENTS

| | | | | |
|---|---|---|---|---|
| 2012/0060669 | A1 | 3/2012 | Ryan et al. | |
| 2012/0118130 | A1* | 5/2012 | Field | G10H 3/146 84/730 |
| 2013/0125735 | A1 | 5/2013 | Mori | |
| 2014/0053713 | A1 | 2/2014 | Truchses | |
| 2015/0143979 | A1 | 5/2015 | Field | |
| 2016/0210941 | A1* | 7/2016 | Suitor | G10H 3/146 |
| 2016/0247492 | A1* | 8/2016 | Field | G10D 13/024 |

OTHER PUBLICATIONS

International Search Report and Written Opinion for International Application No. PCT/US16/60239 dated Mar. 16, 2017.

* cited by examiner

TECHNIQUES FOR MAGNETICALLY MOUNTING A TRANSDUCER TO A CYMBAL AND RELATED SYSTEMS AND METHODS

FIELD OF INVENTION

The present application relates generally to systems and methods for magnetically mounting a transducer to a cymbal.

BACKGROUND

Cymbals and other percussion instruments are frequently placed in proximity to microphones when the instruments are to be played "live" on stage or played in a recording studio. Typically, a number of microphones are placed surrounding the cymbals to receive sound from the cymbals when they are stuck by a musician. These microphones cannot usually be placed close to the cymbal due to the substantial initial volume of sound produced by a strike of a cymbal.

However, sound produced by a cymbal can be extremely nuanced and microphones placed sufficiently far from the cymbal that they avoid being overwhelmed by the initial strike may not be close enough to the cymbal to pick up such nuanced sound. Moreover, the further a microphone is placed from a cymbal, the more likely it is that the microphone will pick up sounds other than those from the cymbal, such as other nearby instruments generating sounds, leading to a captured audio signal that does not cleanly capture the sound produced by the cymbal.

SUMMARY

According to some aspects, a cymbal system is provided comprising a cymbal, and a vibrational transducer magnetically coupled to the cymbal, the magnetic coupling provided by at least one magnetic component on an upper side of the cymbal and at least one magnetic component on a lower side of the cymbal.

According to some aspects, a method is provided for transducing vibrations of a cymbal, comprising magnetically coupling a vibrational transducer to a cymbal, the magnetic coupling provided by at least one magnetic component on an upper side of the cymbal and at least one magnetic component on a lower side of the cymbal, wherein the vibrational transducer is magnetically coupled to a position that is at least 20% of the radius of the cymbal from the cymbal's center.

According to some aspects, a magnetically mountable cymbal transducer is provided comprising a sound pressure microphone comprising a diaphragm configured to move relative to at least one other component of the sound pressure microphone, said relative motion resulting in a change in capacitance of at least part of the sound pressure microphone, a casing sealing the sound pressure microphone so as to prevent communication of air pressure differentials into the sound pressure microphone, and a magnet coupled to the casing, wherein the magnet has a surface field strength between 1000 gauss and 5000 gauss.

The foregoing is a non-limiting summary of the invention, which is defined by the attached claims.

BRIEF DESCRIPTION OF DRAWINGS

Various aspects and embodiments will be described with reference to the following figures. It should be appreciated that the figures are not necessarily drawn to scale. In the drawings, each identical or nearly identical component that is illustrated in various figures is represented by a like numeral. For purposes of clarity, not every component may be labeled in every drawing.

DETAILED DESCRIPTION

Figure 1:
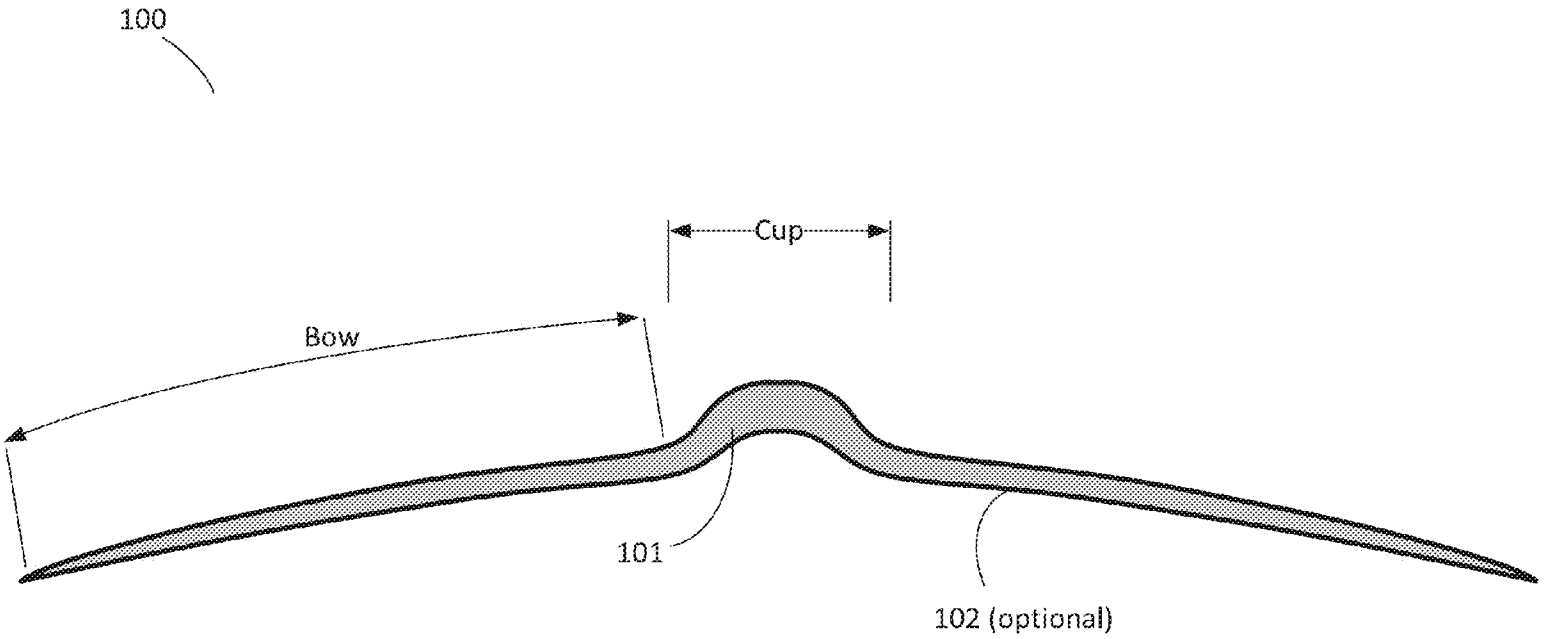
FIG. 1 depicts a cross-section of an illustrative cymbal suitable for practicing some embodiments.

Systems and methods for magnetically mounting a transducer to a cymbal are provided, and in particular, a system and method for magnetically mounting a vibrational transducer to a cymbal using permanent magnets is described. As discussed above, capturing sound using one or more microphones placed in proximity to a cymbal can be challenging due to the complex sound produced by the cymbal and the large difference between an initial acoustic amplitude of a cymbal strike and the acoustic amplitude of the strike after it has decayed for a few seconds.

The inventors have recognized and appreciated that a vibrational transducer, that is, a transducer that converts vibrational movements into an electrical signal, may be attached to a cymbal and its movements used to generate an electrical signal that is indicative of the cymbal's motion, and which therefore is also indicative of sound produced due to the cymbal's motion. Accordingly, a vibrational transducer attached to the cymbal may be used as an audio pickup.

The inventors have further recognized and appreciated, however, that attaching a vibrational transducer to a cymbal via mechanical means may be inconvenient and may negatively affect sound produced by the cymbal. Mechanical fasteners may require that a suitable hole is formed within the cymbal so that that the fastener can securely attach a transducer to the cymbal body. Making such a hole in a cymbal can negatively affect the sound quality of the cymbal since vibrational modes of the cymbal that lead to a desired sound may be disrupted, thereby altering the sound produced by a strike of the cymbal. Moreover, making a hole in a cymbal both irrevocably alters the cymbal and limits use of a vibrational pickup to only the location where the hole is formed. In some use cases it may be advantageous, for example, to utilize different positions of a pickup on a single cymbal, yet mechanical fasteners require that multiple holes be formed for such a configuration. Mechanical clips or other fasteners may exist that do not require structurally altering the cymbal may nonetheless alter the sound produced by a strike of the cymbal.

The inventors have recognized and appreciated that magnetic fastening techniques may mitigate the above described problems with mechanical fasteners, since magnetic fastening does not require alteration of a cymbal to which a pickup is magnetically fastened, and furthermore allows a pickup to be easily installed, removed and/or moved to a new position on a cymbal.

Accordingly to some embodiments, techniques for magnetically fastening a transducer to a cymbal may take advantage of ferromagnetic (or ferrimagnetic) properties of the cymbal. For instance, a cymbal may be formed from a material that exhibits ferromagnetism (e.g., steel, nickel brass) and/or may be coated with a material that exhibits ferromagnetism (e.g., a nickel coating). For example, a magnetic fastener (e.g., comprising a permanent magnet) may readily be attracted to a bronze cymbal having a nickel coating. If the magnetic fastener has a sufficiently strong magnetic field, it may remain in substantially the same location on a cymbal to which it is attached, even after repeated strikes of the cymbal.

According to some embodiments, techniques for magnetically fastening a transducer to a cymbal may utilize magnetic components on two sides of a cymbal. Irrespective of whether the cymbal exhibits ferromagnetic properties, magnetic components may be placed, for instance, on an upper and lower side of a cymbal. Attraction of the magnetic components to one another through the cymbal may provide sufficient force to keep the magnetic components substantially in place after repeated strikes of the cymbal, even if the cymbal itself does not exhibit ferromagnetism. If the cymbal does exhibit ferromagnetism (or ferrimagnetism), use of magnetic components on two sides of a cymbal may provide further coupling by producing attractive forces between the two magnetic components to one another and between each of the magnetic components and the cymbal.

According to some embodiments, a vibrational transducer may be magnetically coupled to a magnetic component. As described above, one or more magnetic components may produce a sufficient force to be held substantially in place on a cymbal, even after repeated strikes of the cymbal. A vibrational transducer may be coupled to any of such magnetic components in any suitable way, such as by mechanically attaching the transducer to a magnetic component, by adhering the transducer to the magnetic component (e.g., using a glue or other adhesive), and/or by utilizing a transducer that exhibits ferromagnetism (or ferrimagnetism) such that the transducer is held in contact with the magnetic component due to a magnetic attraction between the two.

According to some embodiments, a transducer may be magnetically coupled to a cymbal using one or more magnetic components that produce a sufficiently strong force that the transducer remains coupled to the cymbal after the cymbal is struck. As discussed above, the combined force produced by the magnetic components (between themselves and/or between themselves and the cymbal) should be sufficient to hold the magnetic components substantially in place on the cymbal after repeated strikes of the cymbal. A sufficiently strong magnetic field of the magnetic components must therefore be selected to ensure this occurs. In particular, the inventors have found that rare-earth magnets provide a sufficiently high magnetic field strength that a transducer may be attached to a cymbal in this manner.

According to some embodiments, a dampening layer may be provided between a magnetic component and the cymbal to which the magnetic component is attached (by magnetic attraction between the component and the cymbal and/or by magnetic attraction between the component and another magnetic component). The dampening layer may be a thin layer that inhibits motion of a magnetic component during a strike of the cymbal, which may introduce an undesirable source of noise into an electrical signal produced by a transducer coupled to the magnetic component. In some cases, the dampening layer may comprise a gel, silicone and/or a silicone-based material.

As used herein, a "magnetic component" of a magnetic fastener may include any permanently magnetic materials. Since magnetic fasteners as described herein utilize magnetic components to produce forces between one or more pairs of magnetic components and/or forces between a cymbal and one or more magnetic components, a magnetic component should be a component capable of sustaining a magnetic field sufficiently strong to provide fastening and to remain substantially in contact with the cymbal and/or a transducer and/or another magnetic component after repeated strikes of the cymbal. Illustrative materials suitable for use as a magnetic component include, but are not limited to, ferrite magnets, ceramic magnets, rare-earth magnets, alnico magnets, electromagnets, or combinations thereof.

Following below are more detailed descriptions of various concepts related to, and embodiments of, systems and methods for magnetically mounting a transducer to a cymbal. It should be appreciated that various aspects described herein may be implemented in any of numerous ways. Examples of specific implementations are provided herein for illustrative purposes only. In addition, the various aspects described in the embodiments below may be used alone or in any combination, and are not limited to the combinations explicitly described herein.

Although particular shapes and sizes of cymbals are described and shown herein, it is envisioned that the functionality of the various disclosed techniques for magnetically mounting a transducer may be applied to any type of percussion instrument that has a metallic surface. For instance, the techniques described herein may be utilized with a cymbal of any size, shape or type, such as, but not limited to, cymbals commonly known as a ride, a crash, a hi-hat, a crash/ride, a splash, a China cymbal, and/or a marching cymbal. It will be appreciated that cymbal types, including those indicated above, may be formed in a variety of shapes and sizes, and that the types indicated are broad categorizations known to those of skill in the art.

FIG. 1 depicts a cross-section of an illustrative cymbal suitable for practicing some embodiments. Cymbal 100 includes cymbal body 101 and an optional coating 102. Cymbal body 101 may be of any suitable shape, though in some embodiments may include a bell or "cup" region in the center of the cymbal and/or a "bow" region around the exterior of the cymbal, both of which are indicated in the example of FIG. 1. It should be appreciated that in general, cymbals discussed herein may be of any suitable size and/or shape, though may in some embodiments have the general form shown in FIG. 1. The specific dimensions of each region may be of any suitable size, both in terms of absolute sizes and relative sizes. For example, a cymbal having a small or negligible cup region may be used with embodiments described herein.

Cymbal body 101 may comprise any suitable material, or combination of materials. In some embodiments, cymbal body 101 is constructed from a material that is suitably rigid so as to produce sounds when struck and/or has a hardness such that repeated strikes of the cymbal will not significantly dent or damage the material. In some embodiments, cymbal body 101 comprises a metal. In some embodiments, cymbal body 101 comprises bronze, which may include any formulation of a bronze alloy comprising any proportions of copper and tin in addition to any number and any type of other substances. Suitable bronze alloys may include, but are not limited to, 92% copper and 8% tin alloys (commonly known as "B8"), 80% copper and 20% tin alloys (commonly known as "B20"), Paiste Sound Alloy, bronze comprising between 70% copper and 100% copper by volume and/or by weight, bronze comprising between 0% and 30% tin by volume and/or by weight, bronze comprising silver, and/or any combinations thereof.

Cymbal body 101 may be of any suitable size and/or shape. In the example of FIG. 1, cymbal body 101 is circular when viewed from above and has a cross-section including the bow and cup regions shown. However, cymbal body 101 is not limited to cymbals that have this particular shape or cross-section, and it will be appreciated that the particular shape of cymbal depicted in FIG. 1 is provided merely as an example. Moreover, cymbal body 101 may be of any suitable size, including diameters between 6 inches and 30 inches, and thicknesses between 1 mm and 10 mm. However, cymbal body 101 may also be a vertically mounted gong, for example, and have a diameter between 1 foot and 6 feet.

In some embodiments, cymbal 100 may include an optional coating 102. Coating 102 may comprise any resilient material, such as a resilient material having a hardness between 20 and 500 on the Brinell scale; a resilient material having a tensile strength between 50 MPa and 1000 MPa; a resilient material having a modulus of elasticity between 100 MPa and 100 GPa; and/or a resilient material having a compressive yield strength between 50 MPa and 2000 MPa.

Coating 102 may be of any suitable thickness. For example, coating 102 may have a thickness between 1 μm and 10 mm; for example between 1 mm and 5 mm. Coating 102 may have a homogeneous thickness across an area of cymbal body 101 to which it is applied, though may alternatively, or additionally, have a thickness that varies across the cymbal. For example, coating 102 may have a greater thickness toward an exterior circumference of cymbal body 101 than a thickness at or close to the center of cymbal body 101. Where coating 102 comprises multiple components and/or materials, each component and/or material may have any suitable thickness or thicknesses.

In some embodiments, coating 102 comprises a metal. For example, coating 102 may comprise a metal plated to cymbal body 101 and/or to another component of coating 102. In some embodiments, coating 102 may comprise a powder coating, polytetrafluorethylene (PTFE), one or more anodized materials, or combinations thereof Coating 102 may be applied to cymbal body 101 via any suitable technique or techniques. Coating 102 may comprise multiple layers and/or multiple materials which may be applied to cymbal body 101 in sequence, and/or may be combined separately and then applied to cymbal body 101.

In some embodiments, coating 102 comprises a first layer which dampens vibrations of cymbal body 101 and a second layer applied over at least part of the first layer, which further dampens vibrations of cymbal body 101, and which may also provide a protective coating. For example, coating 102 may comprise an ink applied to the surface of cymbal body 101 and an elastomeric coating applied over the ink. Since some components of coating 102 may provide desirable dampening qualities but may be damaged or otherwise degraded upon repeated strikes of cymbal 100, in some use cases in may be beneficial to include a protective component in coating 102 which can be substantially undamaged by repeated strikes. For example, any one or more of the resilient qualities discussed above (high hardness, etc.) may be utilized in such a protective coating.

Cymbal 100 may produce different types of sound depending on where it is struck. While there are essentially infinite variations in the types of sound, for musical purposes cymbal strikes may be divided into at least three broad categories, including "bell", "bow", and "edge" strikes. Bell strikes are achieved by striking the cymbal near its center, on or around the bell or "cup" region. Bow strikes are achieved by striking the main body of the cymbal with the tip of a stick. Edge strikes are achieved by striking the edge of the cymbal with the side of a stick's shaft. In addition to the various strike types the cymbal may be silenced by grasping the edge of the cymbal (e.g., with a hand), causing vibrations to cease or to at least be significantly damped. This is referred to as "choking" the cymbal. The various strike types and choking are collectively referred to as the instrument's "articulations."

Figure 2A:
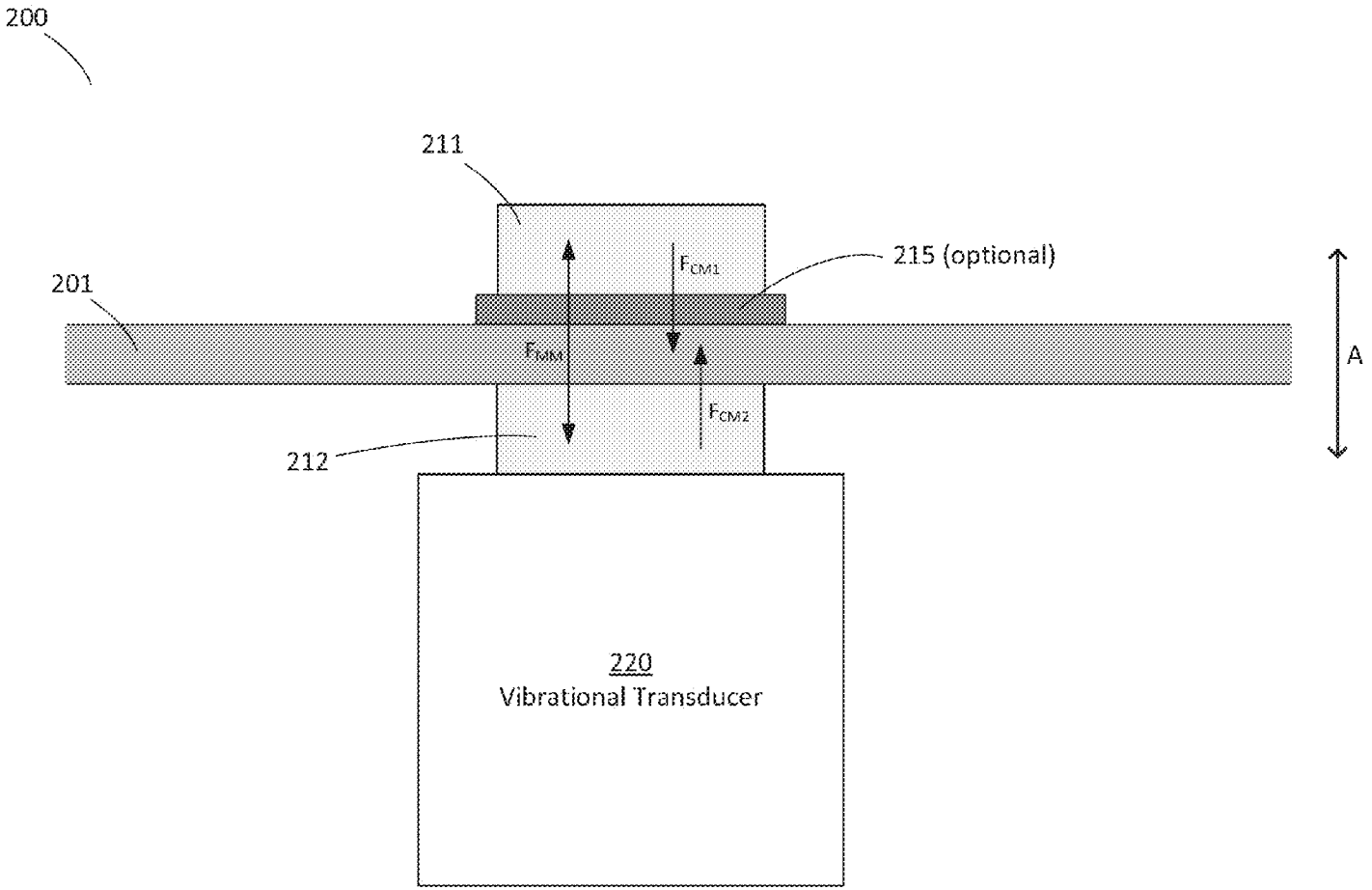
FIG. 2A depicts a cross section of an illustrative cymbal having a vibrational transducer magnetically mounted to its surface, according to some embodiments.
Figure 2B:
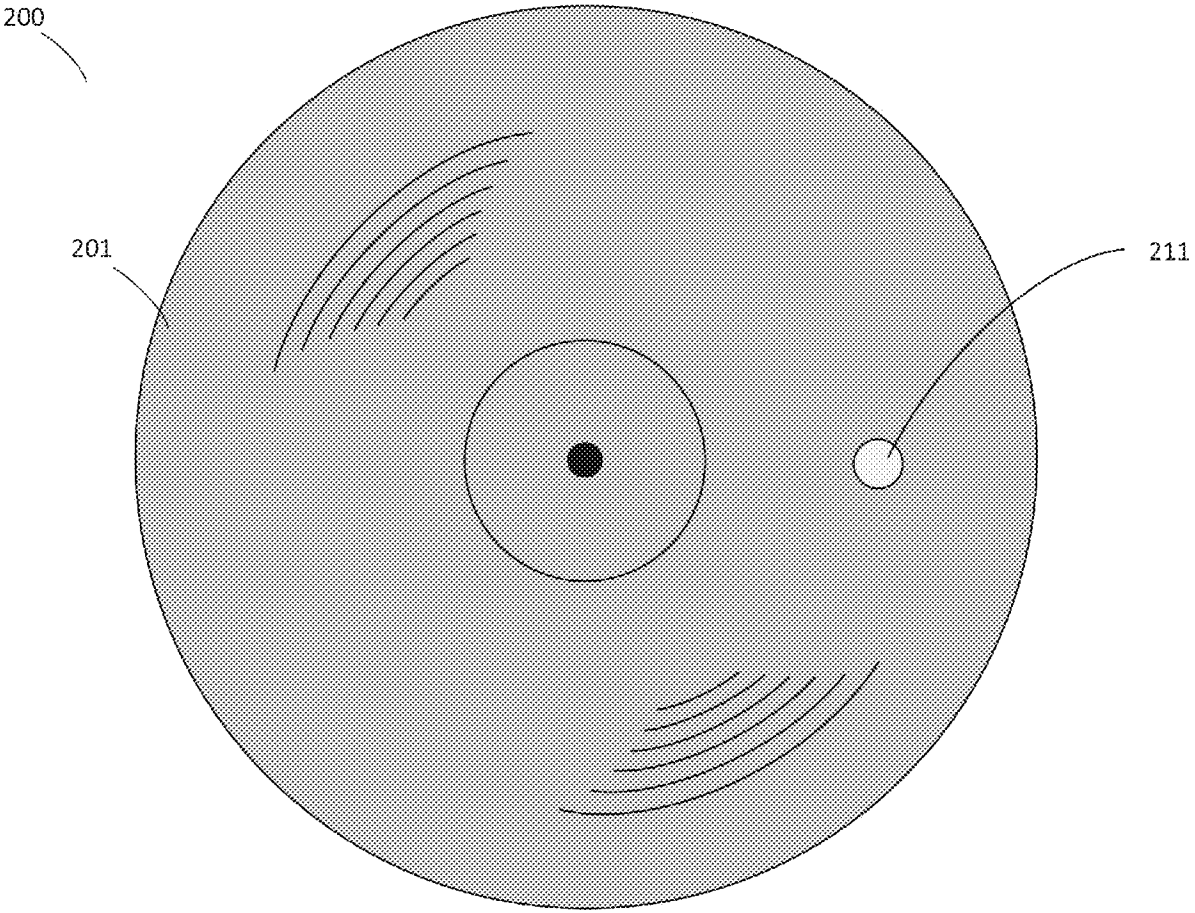
FIG. 2B is a top-down view of the illustrative cymbal depicted in FIG. 2A, according to some embodiments.

FIG. 2A depicts a cross section of an illustrative cymbal having a vibrational transducer magnetically mounted to its surface, according to some embodiments. Cymbal system 200 includes cymbal 201, magnetic components 211 and 212 and vibrational transducer 220. The system may also include an optional dampening layer 215 located between a magnetic component and the cymbal. FIG. 2B is a top-down view of the illustrative cymbal depicted in FIG. 2A, according to some embodiments (optional dampening layer 215 is omitted in FIG. 2B for clarity).

Magnetic components 211 and 212 may include any suitable permanent magnets. In some embodiments, magnetic components 211 and/or 212 may comprise a rare-earth magnet, such as, but not limited to, NdFeB, SmCo, or combinations thereof. In general, however, magnetic components 211 and 212 may each comprise any number of magnetic elements in addition to zero or more non-magnetic elements, such that the ensemble of elements produces a magnetic field. In some embodiments, magnetic components 211 and 212 exhibit different magnetic fields, such as different surface field strengths and/or different maximum field strengths.

According to some embodiments, magnetic components 211 and/or 212 may have a surface magnetic field strength between 500 gauss and 10,000 gauss, such as between 1000 gauss and 5000 gauss, such as between 2000 and 4000 gauss, such as approximately 3000 gauss. According to some embodiments, magnetic components 211 and 212 may produce magnetic fields having substantially the same surface strengths and/or maximum field strengths. According to some embodiments, magnetic components 211 and/or 212 may have a maximum energy product between 10 and 60 MegaGaussOersteds (MGOe), such as between 25 and 50 MGOe, such as between 35 and 45 MGOe, such as approximately 42 MGOe. According to some embodiments, magnetic components 211 and/or 212 may have a substantially cylindrical shape with a magnetization direction along the cylindrical axis.

Cymbal 201 may have any combination of properties described above in regards to cymbal 100 shown in FIG. 1. In some embodiments, cymbal 201 is a bronze cymbal with nickel plating. In the example of FIG. 2A, cymbal 201 exhibits ferromagnetism (e.g., by being formed from, or including a ferromagnetic material within the cymbal body and/or within a coating applied to the cymbal body). As a result, multiple magnetic forces are produced within system 200. These are: $F_{MM}$, a force exerted upon each of the two magnetic components 211 and 212; $F_{CM1}$, a force exerted between the magnetic component 211 and the cymbal 201; and $F_{CM2}$, a force exerted between the magnetic component 212 and the cymbal 201. Magnetic couplings between these components, which depends both on magnetic field strengths produced by magnetic components 211 and 212 and on the extent of the ferromagnetic properties of the cymbal 201, may together cause the combined system to substantially retain its position after repeated strikes of the cymbal. Since the combination of the magnetic components 211 and 212 is coupled to vibrational transducer 220, the transducer also thereby retains its position while moving in concert with the cymbal.

Vibrational transducer 220 may include any transducer that converts motion of the cymbal 201 (e.g., in direction A) into an electrical signal. For instance, vibrational transducer 220 may include an electret microphone, a piezoelectric sensor (e.g., a piezoceramic), a microelectromechanical systems (MEMS) device and/or an accelerometer. For clarity, an electrical connection extending from the transducer 220 is not shown in FIGS. 2A-2B, but in general the transducer may be electrically connected to an electronic device that may convert, read out or otherwise receive a signal indicative of motion of the cymbal.

Vibrational transducer 220 may be attached to magnetic component 212 via any suitable means. In some embodiments, vibrational transducer 220 includes a housing that exhibits ferromagnetism and the vibrational transducer may be affixed to the magnetic component 212 due to a magnetic attraction between the two. In some embodiments, vibrational transducer 220 may be attached to the magnetic component 212 via one or more mechanical fasteners and/or via an adhesive. According to some embodiments, a single housing may include both magnetic component 212 and the vibrational transducer 200 such that the magnetic force of magnetic component 212 is applied to the cymbal 201 through the housing.

Optional dampening layer 215 may include any material that aids in dampening vibrations of a magnetic component with which it is in contact (component 211 in the example of FIGS. 2A-2B). In some embodiments, dampening layer 215 may include a gel (e.g., a silicone gel), rubber, an elastomer, plastic (e.g., PVC), foam (e.g., polyurethane), or combinations thereof. In some use cases, the dampening layer may be adhesively attached to the cymbal 201 and/or the magnetic component 211. Alternatively, the dampening layer may be held in place between the magnetic component 211 and the cymbal 201 primarily due to the magnetic force $F_{CMI}$ and/or $F_{MM}$.

As discussed above, a magnetically fastened transducer may be easily moved around a cymbal, which may allow a musician latitude to find an ideal location for a desired sound measured by the transducer. In the example of FIG. 2B, the transducer is located roughly 70% of the radius of the cymbal from the center of the cymbal. Generally, the transducer may be placed in any location, though may preferably be placed at least 20% of the radius of the cymbal from its center so that the cymbal causes a greater displacement of the transducer when the cymbal is struck. Such a choice may, however, be weighed against the impact force that results against the transducer's coupling to the cymbal via the magnetic components, since a greater displacement of the transducer generally produces a greater impact force and thereby requires a stronger force to couple the transducer to the cymbal.

While FIGS. 2A-2B illustrate a particular configuration of magnetic components and a vibrational transducer, it will be appreciated that other configurations may be equally applicable to magnetic fastening of a transducer. For instance, multiple magnetic components may be provided above and/or below the cymbal 201 and/or multiple dampening layers may be included above and/or below the cymbal. For example, two magnetic components may be provided above the cymbal and one magnetic component may be provided below the cymbal, and a dampening layer may be provided between each magnetic component and the cymbal.

Figure 3:
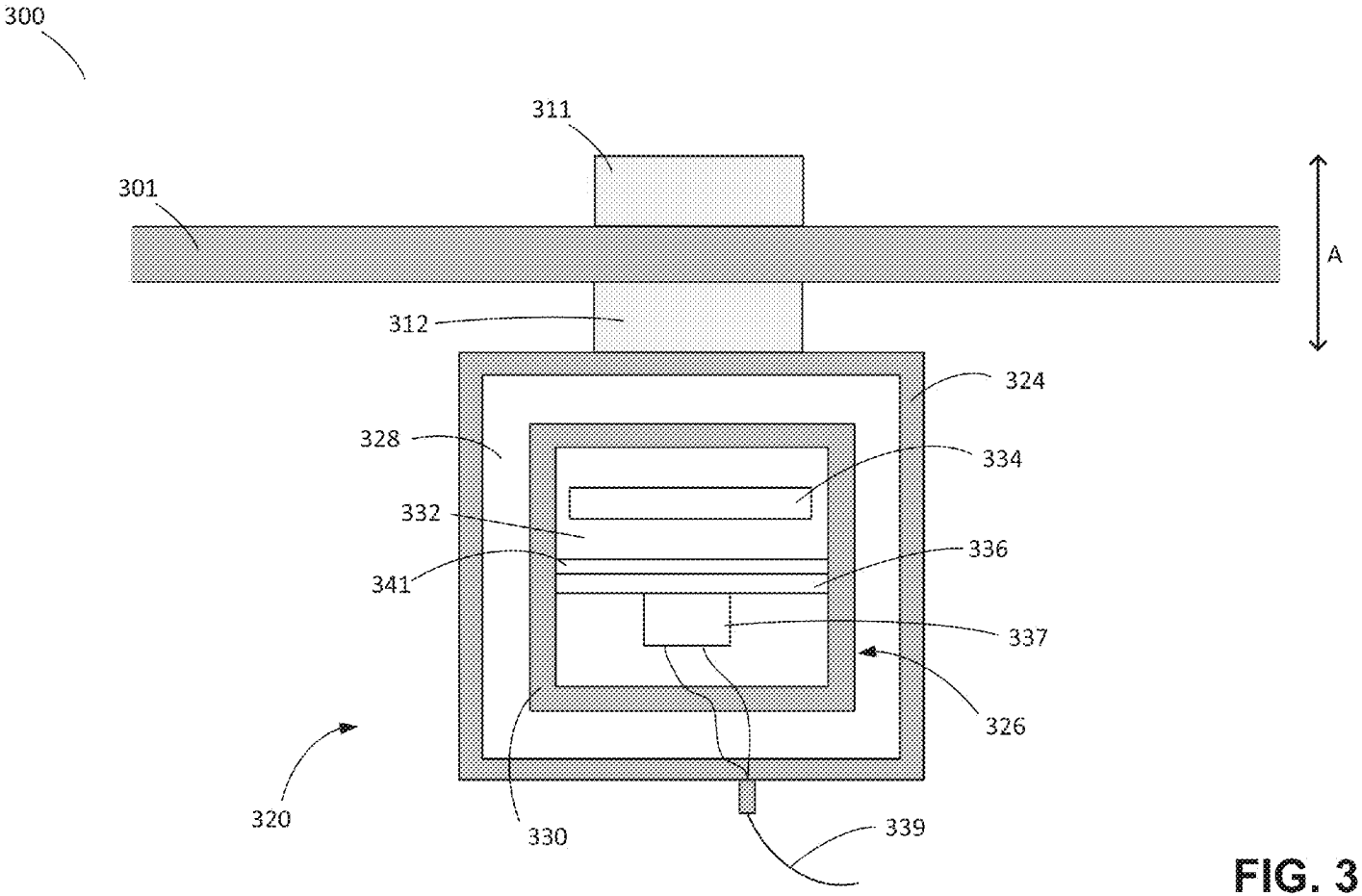
FIG. 3 depicts a cross section of an illustrative cymbal having an electret microphone magnetically mounted to its surface, according to some embodiments.

FIG. 3 depicts a cross section of an illustrative cymbal having an electret microphone magnetically mounted to its surface, according to some embodiments. In the example of FIG. 3, cymbal system 300 includes cymbal 301, magnetic components 311 and 312, and encapsulated electret microphone 320. Cymbal 301 may have any combination of properties described above in regards to cymbal 100 shown in FIG. 1, and magnetic components 311 and 312 may have any combination of properties described above in regards to magnetic components 211 and 212 shown in FIGS. 2A-2B.

FIG. 3 is depicted to illustrate a configuration of magnetically fastening a transducer to a cymbal in the case where the transducer is an encapsulated electret microphone 320. The encapsulated electret microphone 320 includes a housing 324 encapsulating a sound pressure microphone such as an electret microphone 326. Encapsulation as used herein refers to a substantial or complete isolation of the sound pressure microphone from external air pressure differentials. This may be accomplished, for instance, by hermetically sealing the microphone within a casing 328 and a housing 324. In some embodiments, casing 328 may include rubber, metal and/or a resin.

The electret microphone 326 comprises a microphone housing 330 defining a cavity 332 in which a thin, metallized diaphragm 334 is resiliently mounted for relative motion therein. Diaphragm 334 constitutes one plate of a capacitor, the other plate of which, 336, is fixed within microphone housing 330. An electret 341 for charge storage may be disposed on one of the plates 334 or 336. A plurality of electrical circuit components 337 may respond electrically to changes in capacitance between the plates 334 and 336 due to movement of the diaphragm resulting from vibration-induced accelerative forces of cymbal 301, and may thereby generate an output signal on conductor(s) 339 that are indicative of the movement of the cymbal.

It will be appreciated that the electret microphone 320 is provided as one illustrative vibrational transducer and that the application is not limited to this particular vibrational transducer design, nor to the particular technique exhibited by the electret microphone of transforming physical motion into an electrical signal. In general, any suitable transducer that produces an electrical signal from physical motion may be utilized.

Having thus described several aspects of at least one embodiment of this invention, it is to be appreciated that various alterations, modifications, and improvements will readily occur to those skilled in the art.

Such alterations, modifications, and improvements are intended to be part of this disclosure, and are intended to be within the spirit and scope of the invention. Further, though advantages of the present invention are indicated, it should be appreciated that not every embodiment of the technology described herein will include every described advantage. Some embodiments may not implement any features described as advantageous herein and in some instances one or more of the described features may be implemented to achieve further embodiments. Accordingly, the foregoing description and drawings are by way of example only.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. A cymbal system comprising:

a cymbal; and a vibrational transducer magnetically coupled to the cymbal, the magnetic coupling provided by:

at least one first permanent magnet disposed on a lower side of the cymbal and attached to the vibrational transducer; and at least one second permanent magnet disposed on an upper side of the cymbal, the at least one first permanent magnet and at least one second permanent magnet being on opposing sides of the cymbal and being magnetically coupled to the cymbal, at least in part, by a magnetic force of attraction between the at least one first permanent magnet and at least one second permanent magnet that acts through the cymbal.

2. The cymbal system of claim 1, wherein the transducer comprises a piezoelectric sensor.

3. The cymbal system of claim 1, wherein the transducer comprises an electret accelerometer.

4. The cymbal system of claim 1, wherein the cymbal includes a plurality of perforations.

5. The cymbal system of claim 1, wherein the cymbal comprises bronze.

6. The cymbal system of claim 1, wherein the at least one first permanent magnet and the at least one second permanent magnet each comprise a rare earth magnet.

7. The cymbal system of claim 6, wherein the rare earth magnet has a surface magnetic field strength between 1000 gauss and 5000 gauss.

8. The cymbal system of claim 1, wherein the at least one first permanent magnet and at least one second permanent magnet are further magnetically coupled to the cymbal by a magnetic attraction between the at least one first permanent magnet and the cymbal, and by a magnetic attraction between the at least one second permanent magnet and the cymbal.

9. The cymbal system of claim 1, wherein the at least one first permanent magnet and the at least one second permanent magnet have substantially the same surface magnetic field strength.

10. The cymbal system of claim 1, further including a gel layer between the cymbal and the at least one first permanent magnet.

11. The cymbal system of claim 1, wherein the vibrational transducer is magnetically coupled to a position that is at least 20% of the radius of the cymbal from the cymbal's center.

* * * * *